US010581152B2

(12) United States Patent
Ferrando et al.

(10) Patent No.: US 10,581,152 B2
(45) Date of Patent: Mar. 3, 2020

(54) BIAXIAL ANTENNA COMPRISING A FIRST FIXED PART, A SECOND ROTARY PART AND A ROTARY JOINT

(71) Applicant: THALES, Courbevoie (FR)

(72) Inventors: Nicolas Ferrando, Toulouse (FR); Jérôme Brossier, Toulouse (FR); Yann Cailloce, Toulouse (FR); Jérôme Lorenzo, Toulouse (FR)

(73) Assignee: Thales, Courbevoie (FR)

( * ) Notice: Subject to any disclaimer, the term of this patent is extended or adjusted under 35 U.S.C. 154(b) by 2 days.

(21) Appl. No.: 16/133,715

(22) Filed: Sep. 18, 2018

(65) Prior Publication Data

US 2019/0089045 A1 Mar. 21, 2019

(30) Foreign Application Priority Data

Sep. 19, 2017 (FR) ..... 17 00948

(51) Int. Cl.

| | |
|---|---|
| ***H01Q 3/08*** | (2006.01) |
| ***H01Q 1/42*** | (2006.01) |
| ***H01Q 1/12*** | (2006.01) |
| ***H01P 1/06*** | (2006.01) |
| ***H01Q 19/19*** | (2006.01) |
| ***H01Q 3/20*** | (2006.01) |

(52) U.S. Cl.

CPC ..... *H01Q 1/428* (2013.01); *H01P 1/063* (2013.01); *H01P 1/068* (2013.01); *H01Q 1/1264* (2013.01); *H01Q 3/08* (2013.01); *H01Q 3/20* (2013.01); *H01Q 19/192* (2013.01)

(58) Field of Classification Search

CPC ..... H01Q 1/1207–1/1264; H01Q 3/02–3/20; H01Q 19/18–19/19; H01P 1/06

See application file for complete search history.

(56) References Cited

U.S. PATENT DOCUMENTS

| | | | | |
|---|---|---|---|---|
| 2,595,186 | A | 4/1952 | Breetz | |
| 9,368,867 | B2 * | 6/2016 | Evans | H01Q 3/20 |
| 9,647,334 | B2 * | 5/2017 | Lanciault | H01Q 3/20 |
| 9,812,776 | B2 * | 11/2017 | Yano | H01P 1/064 |

(Continued)

FOREIGN PATENT DOCUMENTS

| | | | |
|---|---|---|---|
| FR | 2984612 | A1 | 6/2013 |
| FR | 3029018 | A1 | 5/2016 |
| WO | 2008104998 | A2 | 9/2008 |

OTHER PUBLICATIONS

French Patent Application No. 17 00948, INPI Rapport de Recherche Préliminaire, dated Jun. 11, 2018, 2 pages.

*Primary Examiner* — Dameon E Levi
*Assistant Examiner* — Hasan Z Islam
(74) *Attorney, Agent, or Firm* — Soquel Group LLC

(57) ABSTRACT

This antenna includes a first part, a second part rotatably mounted about a first axis, and a rotary joint arranged between the first and second parts, the second part including a radiating source and a reflection assembly having a reflector defining a reflector top, a focus, and a second axis passing through the reflector top and the focus, the rotary joint being able to transmit electromagnetic signals between the first and second parts via at least one transmission channel, and the first and second parts being so arranged that in any position of the second part and the reflection unit, the first axis is perpendicular to the second axis.

11 Claims, 5 Drawing Sheets

(56) References Cited

U.S. PATENT DOCUMENTS

| | | | |
|---|---|---|---|
| 2010/0149058 | A1 | 6/2010 | Bosshard et al. |
| 2014/0104125 | A1 | 4/2014 | Choiniere et al. |
| 2016/0149280 | A1 | 5/2016 | Lorenzo et al. |

* cited by examiner

BIAXIAL ANTENNA COMPRISING A FIRST FIXED PART, A SECOND ROTARY PART AND A ROTARY JOINT

CROSS-REFERENCE TO RELATED APPLICATIONS

This application claims priority of French Patent Application No. 17 00948, filed on Sep. 19, 2017.

FIELD OF THE INVENTION

The present invention relates to a biaxial antenna comprising a first fixed part, a second rotary part and a rotary joint.

Such an antenna offers considerable agility in azimuth and elevation pointing, and is particularly useful in the spatial field. More particularly, it may be mounted on satellites with a reduced outer surface, while ensuring the reception and emission of electromagnetic signals for a large bandwidth.

BACKGROUND OF THE INVENTION

Similar antennas are already known in the prior art.

Thus, for example, the document FR 3 029 018 describes a biaxial antenna comprising a fixed part installed on a base and a rotary part mounted on this fixed part. The antenna further comprises a first actuator allowing the rotary part to be rotated about a first axis of rotation that is perpendicular to the base in order to change the azimuth angle of the antenna.

The fixed and rotary parts of this antenna are connected by a connecting device arranged between them along the first axis of rotation for transmitting electromagnetic signals between these parts.

In particular, this connecting device comprises a rotary joint and two exciters arranged on either side of the rotary joint and making it possible to develop radiofrequency waves either in the fundamental electromagnetic mode with circular polarization, or in the electromagnetic mode with symmetry of revolution.

The rotary joint forms a circular section waveguide allowing the propagation of two electromagnetic signals in cross-polarization between the two exciters.

The rotary part of this antenna comprises, in particular, a reflection assembly composed of a reflector and a mirror arranged to face each other and direct electromagnetic signals emitted by a radiating source to an area of visibility of the antenna, or to receive electromagnetic signals from this area. The radiating source is connected to the connection module via, in particular, an exciter.

In addition, the rotary part defines a second axis of rotation and comprises a second actuator designed to rotate, for example, the mirror about this second axis of rotation, in order to change the angle of inclination of the mirror relative to the reflector.

Thus, the pointing of such an antenna at a given azimuth angle and elevation angle is achieved by appropriately actuating the first and second actuators.

However, the architecture of this biaxial antenna is not completely satisfactory.

In particular, this antenna does not allow the reception and emission of electromagnetic signals with a bandwidth greater than 1 GHz width without significant degradation of the performance of the antenna.

SUMMARY OF THE DESCRIPTION

The present invention aims to provide an antenna for receiving and emitting electromagnetic signals with a bandwidth substantially equal to 3 GHz width, while ensuring good performance of this antenna.

For this purpose, the object of the invention is a biaxial antenna comprising a first part intended to be fixed on a base defining a base plane, a second part mounted to rotate about a first axis on the first part, and a rotary joint arranged between the first and second parts; wherein the second part comprises a radiating source that is able to emit and receive electromagnetic signals; wherein a reflection assembly comprises a reflector arranged to face the radiating source and a mirror arranged around the radiating source and connected to the reflector that is inclined with respect thereto, wherein the reflector defines a reflector vertex, a focus and a second axis passing through the reflector apex and focus, and wherein the reflection assembly may rotate about the second axis.

The rotary joint is able to transmit electromagnetic signals between the first and the second parts via at least one transmission channel included in a transmission plane that is substantially perpendicular to the first axis. The first and second parts are so arranged that the first axis is substantially perpendicular to the second axis in any position of the second part and the reflection assembly.

According to other advantageous aspects of the invention, the biaxial antenna comprises one or more of the following characteristics, taken in isolation or in any technically feasible combination:

- the first axis is parallel to the base plane;
- the angle formed between the second axis and the base plane corresponds to an angle of elevation of the antenna, while the rotation of the second part about the first axis modifies the elevation angle of the antenna;
- the mirror of the reflection assembly is a mirror with a shape designed according to the mission of the antenna and is preferably a flat mirror;
- the rotary joint is capable of transmitting electromagnetic signals between the first and the second parts via at least two separate transmission channels separated from each other by means for delimiting the electromagnetic signals, wherein the two channels are included in the transmission plane;
- one of the transmission channels is designed to transmit electromagnetic signals received by the radiating source, while the other transmission channel is designed to transmit electromagnetic signals for emission by the radiating source;
- the rotary joint comprises a stator fixed to the first part and a rotor fixed to the second part of the antenna and arranged to at least partly face the stator but without contact;
- the transmission plane is between the stator and the rotor;
- the stator and the rotor have similar shapes of a center ring sector arranged on the first axis;
- the, or each, transmission channel extends in a circumferential direction defined with respect to the first axis; and
- a single exciter arranged in the second part and connected, on the one hand, to the radiating source and, on the other hand, to the rotary joint by waveguides or coaxial cables.

The invention also relates to a rotary joint for a rotary antenna comprising a first part and a second part that are rotatable relative to the first part, wherein the rotary joint is designed to connect the first and second parts of the antenna and to transmit electromagnetic signals between these parts, having a shape of a ring sector with a variable opening and defining an axis of rotation passing through the ring center, a plurality of radial directions extending from the ring center towards its periphery, and a plurality of circumferential directions extending in concentric circles around the axis of rotation.

The rotary joint comprises a stator that is intended to be fixed on the first part of the antenna and defines a transmission surface of the electromagnetic signals perpendicular to the axis of rotation; and a rotor for attachment to the second part of the antenna and defines a transmission surface of the electromagnetic signals perpendicular to the axis of rotation.

One of the transmission surfaces comprises primary means for delimiting the electromagnetic signals while the other transmission surface comprises complementary means for delimiting the electromagnetic signals.

The rotor is mounted to rotate about the axis of rotation relative to the stator so that at any position of the rotor, at least a part of the rotor transmission surface is arranged to face at least a part of the stator transmission surface.

In any rotor position, the facing parts of the rotor and stator transmission surfaces form at least one transmission channel for the electromagnetic signals between them, wherein the transmission channel is delimited by the main and complementary means of delimitation and extends in a circumferential direction.

In other aspects, the joint comprises one or more of the following features, taken in isolation or in any technically feasible combination:

- in any position of the rotor, the parts facing the transmission surfaces of the rotor and the stator form between them at least two channels for transmitting electromagnetic signals, called circumferential channels, wherein the circumferential channels are delimited by the main and complementary means of delimitation and extend in the same circumferential direction;
- in any position of the rotor, the parts facing the transmission surfaces of the rotor and the stator form between them at least two transmission channels of the electromagnetic signals, called radial channels, wherein the radial channels are delimited by the main and complementary means of delimitation and extend in different circumferential directions;
- the radial channel extending in the circumferential direction closer to the axis of rotation than the circumferential direction of the other radial channel, or of each other radial channel, is intended to transmit electromagnetic signals received by the antenna; and
- the radial channel extending in the circumferential direction further from the axis of rotation than the circumferential direction of the other radial channel or each other radial channel, is intended to transmit electromagnetic signals for transmission by the antenna;
- the main delimiting means protrude from the corresponding transmission surface to form at least one transmission channel extending in a circumferential direction and defined by these delimiting means in each radial and circumferential direction passing through this channel;
- the complementary delimiting means protrude from the corresponding transmission surface and are received in the, or each, transmission channel in a mobile manner to delimit the circumferential extent of this channel as a function of the position of the rotor;
- the, or each, transmission channel is formed by a part delimited by the complementary delimiting means of the transmission channel or one of the transmission channels;
- the circumferential channels are formed by adjacent parts of the same transmission channel divided by the complementary means of delimitation;
- for the, or each transmission channel, the transmission surface of the stator defines at least one opening arranged at one end of this channel;
- for the, or each, opening of the stator transmission surface, the rotor transmission surface defines an opening arranged on the same circumferential direction as this opening of the stator transmission surface;
- the, or each, transmission channel extending between the opening or one of the openings of the stator transmission surface and the opening of the transmission surface of the rotor corresponding thereto;
- the main and complementary means of delimitation are in the form of a plurality of studs spaced apart from one another;
- the studs of the main delimiting means are distributed on the corresponding transmission surface along several circumferential directions and several radial directions; and
- the transmission surfaces of the rotor and the stator are spaced apart from each other along the axis of rotation without forming contact points.

BRIEF DESCRIPTION OF THE DRAWINGS

These features and advantages of the invention will become apparent upon reading the description which follows, given solely by way of nonlimiting example, and with reference to the appended drawings, wherein.

DETAILED DESCRIPTION

In the remainder of the description, the term "substantially equal to" is understood to mean a relationship of equivalence having a relative error of less than 10%.

Figure 1:
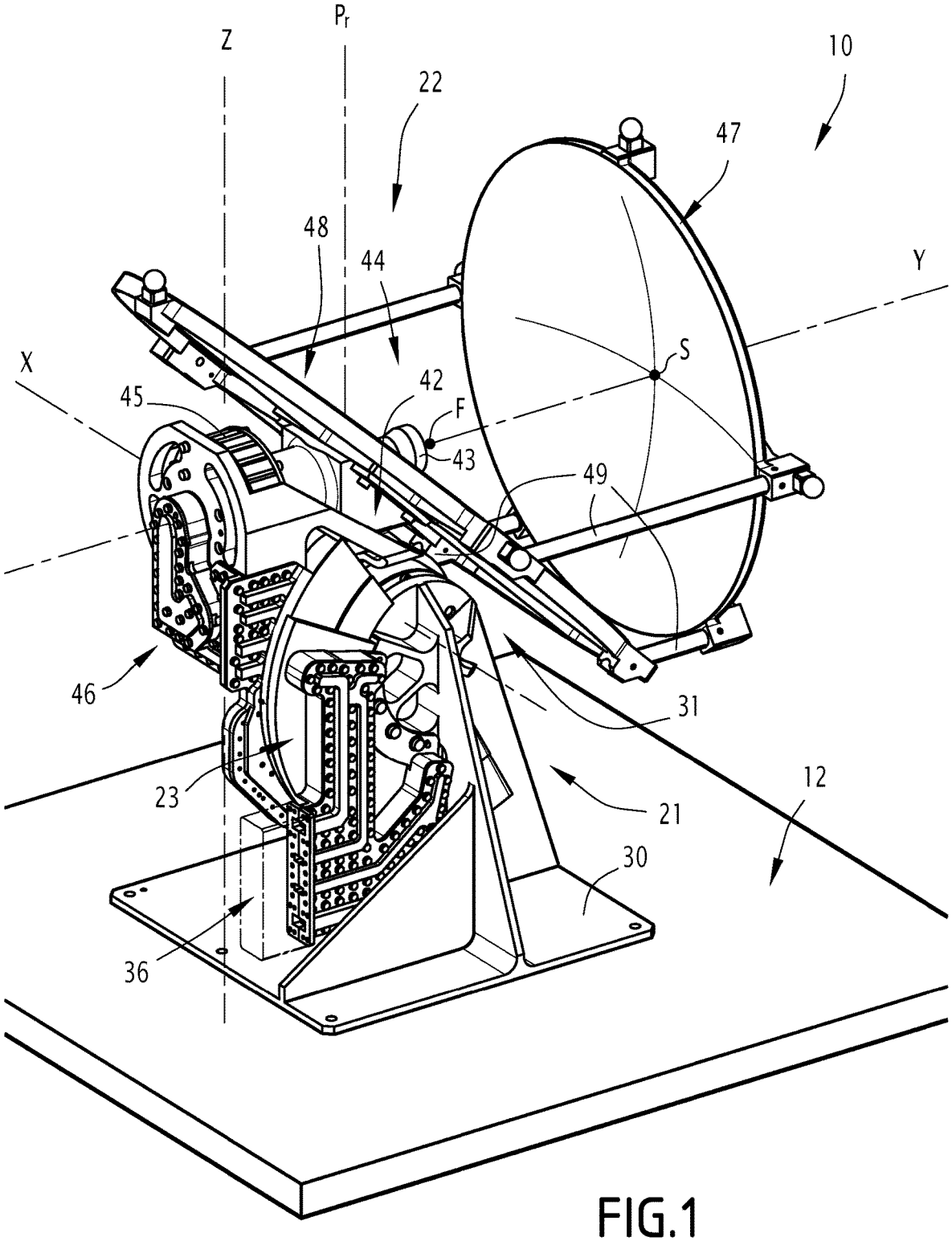
FIG. 1 shows a schematic perspective view of a biaxial antenna according to the invention, wherein the antenna forms a radio frequency chain.

The antenna 10 of FIG. 1 is particularly usable in the spatial domain for receiving and emitting electromagnetic signals in the Ka band in bipolarization. These electromagnetic signals are thus radio waves.

The antenna 10 forms a radiofrequency channel 11 comprising four channels for transmitting the electromagnetic signals, two of which channels are reception channels, i.e. channels of the Rx type, while the other two channels are transmission channels, i.e. type Tx channels.

The antenna 10 is, for example, mounted on an outer surface of a satellite (not shown) arranged, for example, in a low earth orbit. Such an outer surface comprises a base with mechanical fixing means and means for electromagnetic connection of the antenna 10 to the satellite.

The mechanical fixing means make it possible to fix the antenna 10 mechanically to the base.

The electromagnetic connection means make it possible to transmit all the electromagnetic signals between the antenna 10 and the satellite, for example signals received by the antenna 10, signals intended for transmission by the antenna 10 as well as power supply signals of the antenna 10.

In general, the mechanical connection means and the electromagnetic connection means are known as such and will not be detailed below.

The base arranged on the outer surface of the satellite further comprises, at least locally, a base plane 12 that is visible in FIG. 1.

According to other embodiments, the base may have any other form adapted to fix the antenna 10 in a manner known per se. In this case, a base plane means a plane formed by any three contact points of the antenna 10 with the base.

With reference to FIG. 1, the antenna 10 comprises a first part 21 intended to be fixed on the base, a second part 22 mounted to rotate about a first axis X on the first part 21, and a rotary joint 23 arranged between the first and second parts 21, 22.

The first part 21 comprises an antenna support 30, a rotary support 31, a first actuator (not visible in FIG. 1) and first guide means 36 (shown schematically by a parallelepiped in FIG. 1) connecting the antenna 10 to the electromagnetic connection means of the antenna 10.

The antenna support 30 has a mechanical structure necessary to support all the components of the antenna 10. In addition, the antenna support 30 allows the attachment of the antenna 10 to the base and, in particular, to the plane of the antenna base 12 via the mechanical fixing means mentioned above.

The rotary support 31 has a mechanical connection of the second part 22 of the antenna 10 to the first part 21. Thus, for example, the rotary support has a shaft rotating relative to the first part 21 and integral with the second part 22. This shaft is arranged along the first axis X.

The first actuator is able to drive the rotary support 31 with a rotary movement about the first axis X in order to rotate the second part 22 of the antenna 10 with respect to this axis X.

In particular, the first actuator has, for example, an electric motor integrated in the antenna support 30, wherein the rotary support 31 is in the form of a rotary shaft that is designed to drive a rotary movement of the shaft. Such a motor is connected to the first guide means 36 for receiving power supply signals from the satellite. These signals make it possible, in particular, to actuate the operation of the motor to turn the rotary support 31 in order to reach a desired elevation angle Θ.

The elevation angle Θ of the antenna 10 corresponds, in particular, to the angle formed between a second axis Y and the base plane 12. The second axis Y is perpendicular to the first axis X and to a third axis Z perpendicular to the base plane 12.

The first actuator is, for example, designed to vary the elevation angle Θ of the antenna between −30° and 30°, or preferably between −60° and 60°.

The second part 22 of the antenna 10 comprises a second rotary support 42, a radiating source 43, a reflection assembly 44, a rotary assembly 45, a second actuator (not visible in FIG. 1) and second guide means 46 of the electromagnetic signals.

The second rotary support 42 has a mechanical structure that is able to support all the components of the second part 22 of the antenna 10. It also makes it possible to fix the second part 22 of the antenna 10 to the first part 21 in order for it to be rotatable about the first axis X.

Thus, for example, when the first rotary support 31 is in the form of a rotary shaft, the second rotary support 42 is integral with this shaft.

The radiating source 43 is able to emit and receive electromagnetic signals and is, for example, in the form of a horn for transmitting and receiving radio waves and that is known per se.

According to another exemplary embodiment, the radiating source 43 is in the form of a plurality of horns for transmitting and/or receiving radio waves.

The radiating source 43 is fixedly mounted on the second rotary support 42 and is directed along the second axis Y. When the radiating source 43 is in the form of a single horn, this horn is thus directed along the second axis Y. When the radiating source 43 is in the form of a plurality of horns, the maximization of the efficiency of the antenna requires that the horns are directed towards the center of a reflector 47 of the reflection assembly 44. However, due to cost issues with this solution, the horns may be directed along the second axis Y.

In addition to the reflector 47, the reflection assembly 44 comprises a mirror 48 arranged around the radiating source 43 and the fixing means 49.

The reflector 47, known per se, is arranged to face the radiating source 43 and has, for example, a symmetrical parabolic shape defining a reflector top S and a focus F which are visible in FIG. 1. The reflector aperture S presents, for example, the point of symmetry of the reflector 47. Furthermore, the reflector top S and the focus F are arranged on the second axis Y.

The mirror 48 is, for example, a ring-shaped flat mirror in the center of which is arranged the radiating source 43. In this case, the mirror 48 defines a mirror plane and is arranged so that the first axis X is parallel to the plane mirror or comprised in it.

The fixing means 49 make it possible, on the one hand, to fix the mirror 48 to the rotary assembly 45 and, on the other hand, to fix the reflector 47 to the mirror 48.

In particular, between the reflector 47 and the mirror 48, the fixing means 49 are in the form of a plurality of braces arranged at different levels with respect to the second axis Y. Thus, in the example of FIG. 1, two braces are arranged parallel to each other in the part of the reflection assembly 44 having the shortest distance between the reflector 47 and the mirror 48, and two braces are arranged parallel to each other in the part of the reflection assembly 44 having half of the longest distance between the reflector 47 and the mirror 48. An axis perpendicular to the plane formed by these two last braces and passing through the center of the mirror 48 is designated hereinafter as the inclination axis A of the reflection assembly 44.

The reflection assembly 44 and, in particular, the mirror 48 arranged in a fixed manner with respect to the reflector 47, define a propagation axis Pr of the electromagnetic signals.

In particular, the propagation axis Pr corresponds to the direction in which the reflection assembly 44 is able to transmit electromagnetic signals emitted by the radiating source 43 and according to which the reflection assembly 44 is able to receive electromagnetic signals in order to transmit them to the radiating source 43.

In the example described, the propagation axis Pr is perpendicular to the second axis Y. Moreover, in the position of the reflection assembly 44 shown in FIG. 1, the propagation axis Pr is parallel to the third axis Z, while the plane formed by the propagation axis Pr and the second axis Y is perpendicular to the first axis X.

The rotary assembly 45 is mounted on the second rotary support 42 to rotate about the second axis, and is integral with the fixing means 49 of the reflection assembly 44. Thus, the rotation of the rotary assembly 45 about the second axis Y causes the rotation of the reflection unit 44 about the radiating source 43.

The second actuator is, for example, integrated in the second rotary support 42 and is connected to the rotary assembly 45 in order to drive this assembly with a rotational movement.

The second actuator is, for example, substantially similar to the first actuator and is, in particular, in the form of an electric motor. This motor is then connected to a rotary shaft included in the rotary assembly 45.

Like the first actuator, the second actuator is powered by power supply signals from the satellite to enable its operation in reaching an inclination angle $\alpha$ of the desired reflection assembly 44. The inclination angle $\alpha$ of the reflection assembly 44 corresponds to the angle formed between the inclination axis A (visible in particular in FIG. 6) of the reflection assembly 44 and the third axis Z.

The second actuator is, for example, designed to vary the inclination angle $\alpha$ of the reflection assembly 44 between −30° and 30° or preferably between −60° and 60°.

The first and second guide means 36, 46 guide electromagnetic signals within the antenna 10. These means will be explained in more detail with reference to FIGS. 2 and 3 that respectively illustrate a perspective view and an exploded perspective view of the radiofrequency channel 11. By radio frequency channel is meant all the components of the first and second parts 21, 22 of the antenna 10 involved in the transmission of electromagnetic signals within the antenna 10.

In fact, as illustrated in these figures, the radiofrequency channel 11 comprises the radiating source 43, the second guide means 46, the rotary joint 23 and the first guide means 36.

The first guide means 36 make it possible to connect the electromagnetic connection means of the satellite to the rotary joint 23, while the second guide means 46 make it possible to connect the rotary joint 23 to the radiating source 43.

In particular, the first guide means 36 have four transmission channels in the form of waveguides and/or coaxial cables which are bent appropriately according to the arrangement of the electromagnetic connection means of the satellite and of the rotary joint 23.

Each transmission channel of the first guide means 36 is a radiofrequency access channel at the rotary joint 23. In the embodiment of FIG. 1, two channels make it possible to transmit the electromagnetic signals for two orthogonal polarizations, while the two other channels make it possible to receive electromagnetic signals for two orthogonal polarizations.

The second guide means 46 have four transmission channels in the form of waveguides and/or coaxial cables which are appropriately bent according to the arrangement of the rotary joint 23 and the radiating source 43.

Figure 2:
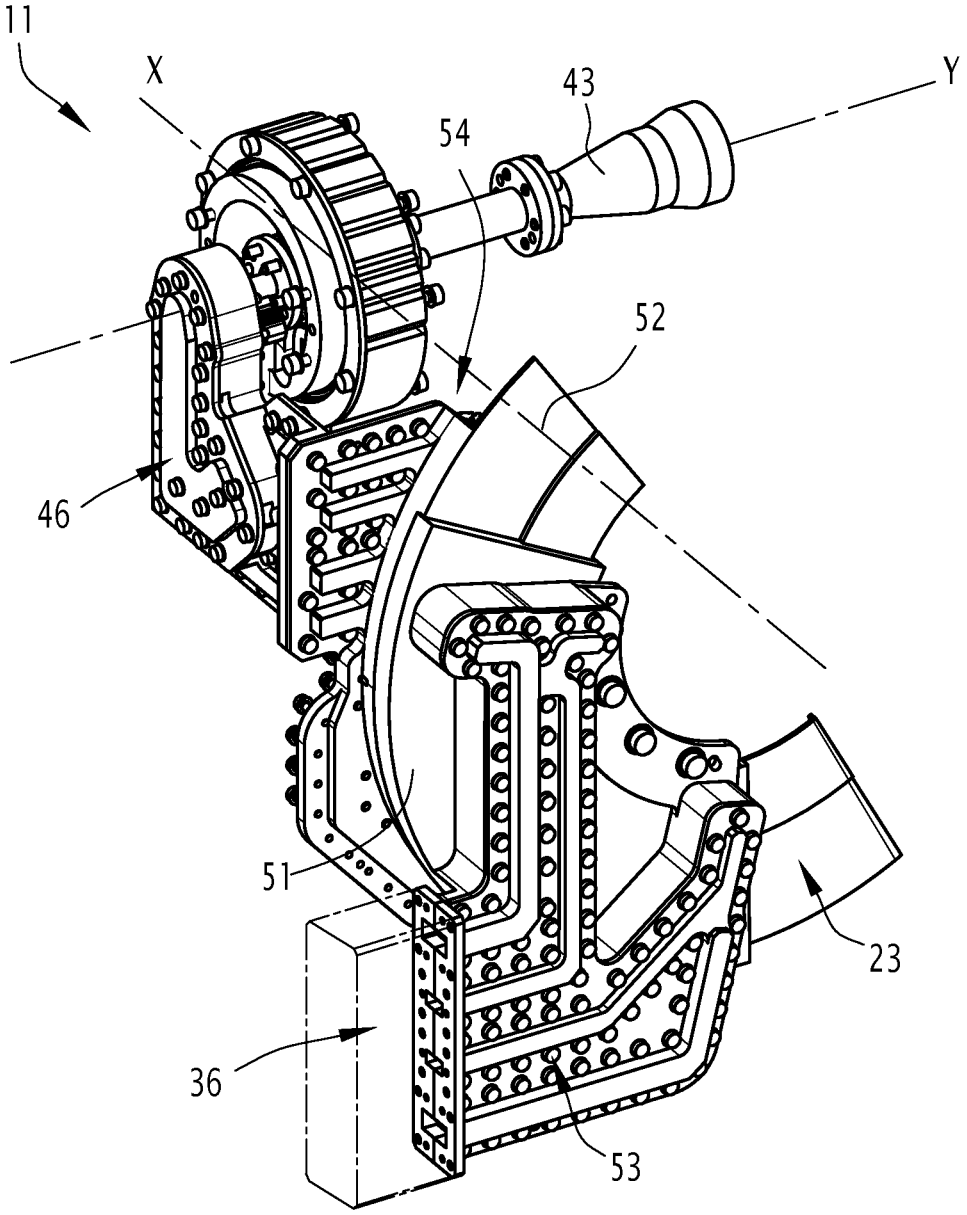
FIG. 2 shows a schematic perspective view of the radiofrequency channel of FIG. 1, wherein the radiofrequency channel comprises a rotary joint comprising a stator and a rotor.
Figure 3:
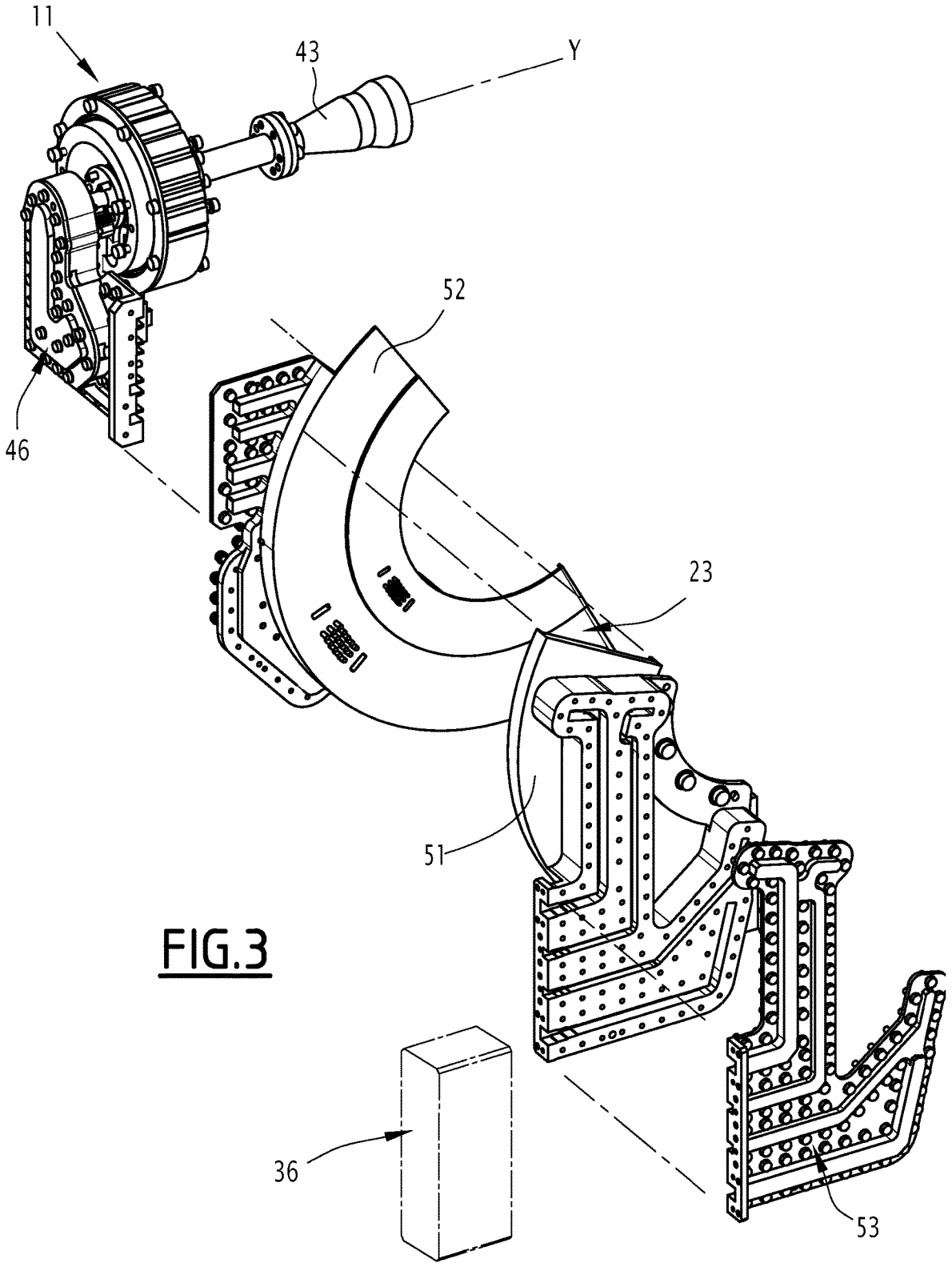
FIG. 3 shows a schematic perspective exploded view of the radiofrequency channel of FIG. 1.

More particularly, in the embodiment of FIGS. 2 and 3, these waveguides and/or these cables are bent so that the electromagnetic signals received by the radiating source 43 along the second axis Y are propagated towards the rotary joint 23 along axes that are parallel to the first axis X, while the electromagnetic signals from the rotary joint 23 along axes parallel to the first axis X are propagated along the second axis Y in the radiating source 43.

As in the previous case, two transmission channels of the second guide means 46 make it possible to transmit the electromagnetic signals for two orthogonal polarizations, while the two other channels make it possible to perform the reception of the electromagnetic signals for two orthogonal polarizations.

In addition, at the point of connection of the second guide means 46 to the radiating source 43, the means comprise an exciter capable of reinforcing and/or polarizing the electromagnetic signals passing through the corresponding transmission channels, according to methods known per se.

In particular, the exciter makes it possible both to generate the desired polarization for the transmission and to receive the desired polarization in reception. In the case of a plurality of horns, the second guide means 46 comprise as many exciters as the horns that are necessary for implementing the mission of the antenna 10.

The rotary joint 23 comprises a stator 51, a rotor 52, a stator cover 53 and a rotor cover 54.

The rotary joint 23 has the shape of a center ring sector arranged on an axis of rotation defined by the joint which coincides with the first axis X.

This sector has a variable opening angle as a function of the position of the rotor 52 relative to the stator 51 to vary, for example, between substantially 160° in a position of minimum opening and substantially 220° in two positions of maximum opening.

Furthermore, this sector defines a plurality of radial directions extending from the ring center to its periphery and a plurality of circumferential directions extending in concentric circles arranged around the first axis X. Thus, each radial direction and each circumferential direction are located in a plane perpendicular to the first axis X and, in the embodiment of FIG. 1, perpendicular to the base plane 12.

The rotor 52 and the rotor cover 54 are fixed to the second part 22 of the antenna 10 and, in particular, to the second rotating support 42. The stator 51 and the stator cover 53 are fixed to the first part 21 of the antenna 10 and, in particular, to the antenna support 30. Thus, during the rotation of the second part 22 of the antenna 10 relative to the first part 21, the rotor 52 rotates relative to the first axis X without coming into contact with the stator 51. This rotation then varies the opening angle value of the rotary joint 23.

The rotor 52 and the stator 51 will be explained in detail later with reference to FIGS. 4 and 5, respectively.

Figures 4, 5:
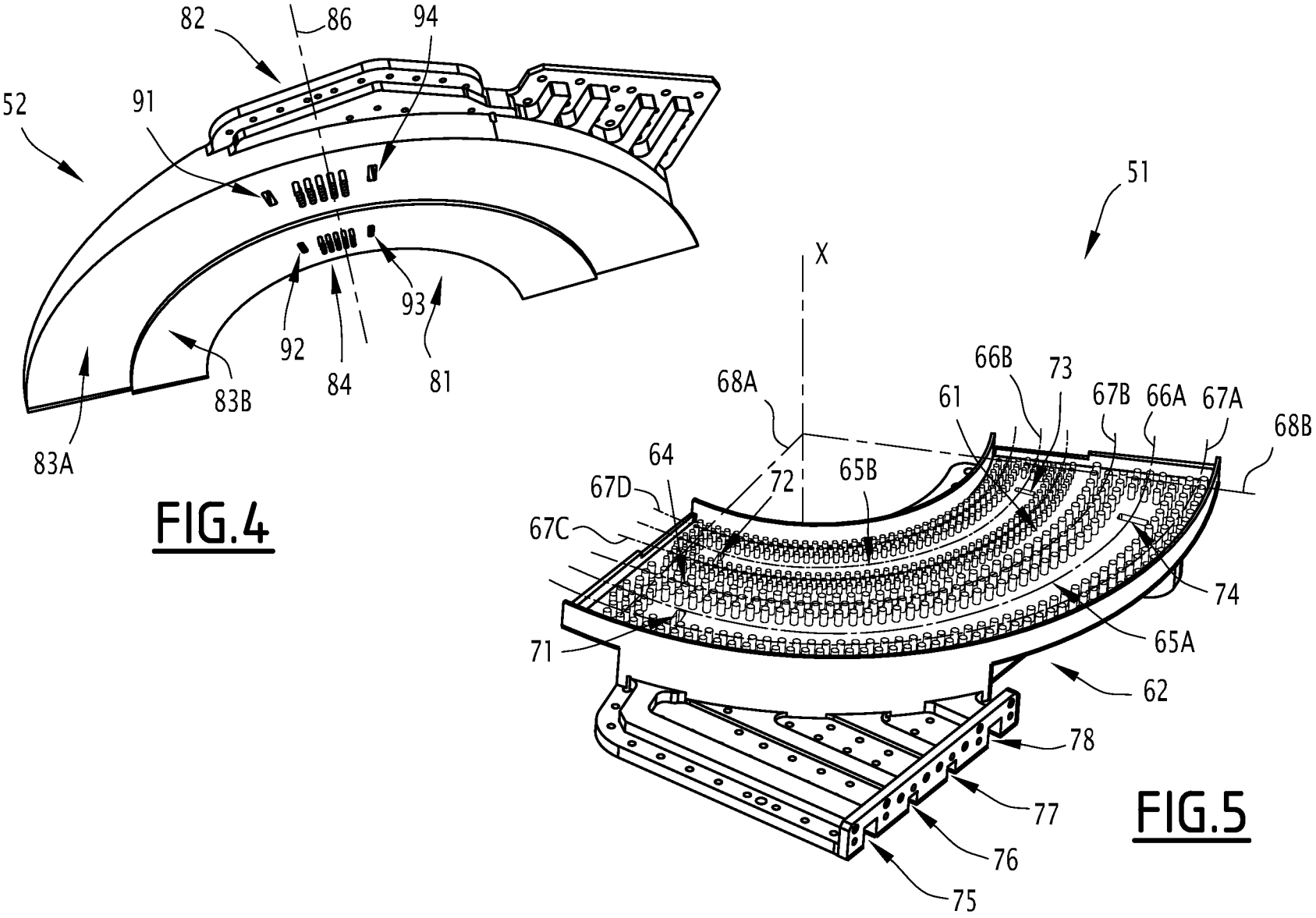
FIG. 4 shows a schematic perspective view of the rotor of FIG. 2.
FIG. 5 shows a schematic perspective view of the stator of FIG. 2.

Thus, with reference to FIG. 5, the stator 51 has the shape of a ring sector of constant opening, and a center arranged on the first axis X. The opening angle of this sector is for example substantially equal to 160°.

The stator 51 is made, for example, of a single piece of a conductive material.

The stator 51 has a transmission surface 61 arranged to face the rotor 52, and a fixing surface 62 covered by the stator cover 53.

The transmission surface 61 comprises main means for delimiting the electromagnetic signals 64 protruding with respect to the transmission surface 61 and forming two transmission channels 65A and 65B of the electromagnetic signals.

Each of these transmission channels 65A, 65B extends in a circumferential direction 66A, 66B and is delimited by the means 64 in each radial and circumferential direction passing through this channel. The width of each of these channels 65A, 65B, i.e. its extent in each radial direction, is, for example, substantially equal to 7 mm.

In the embodiment of FIG. 5, the transmission channel 65A extending in the circumferential direction 66A further from the first axis X than the circumferential direction 66B, is intended to transmit electromagnetic signals for transmission by the antenna 10 i.e. Tx type signals.

The transmission channel 65B extending in the circumferential direction 66B closer to the first axis X than the circumferential direction 66A, is for transmitting electromagnetic signals received by the antenna 10, i.e. Rx type signals.

The main means of delimitation 64 are in the form of a plurality of studs spaced apart from one another in a homogeneous manner. These studs have, for example, a cylindrical shape with a diameter of between 1.5 mm and 2.5 mm.

The studs delimiting the same transmission channel 65A, 65B are of the same dimensions and are distributed on the transmission surface 61 in several circumferential directions on either side of the corresponding transmission channel, and at each end of this channel along several radial directions.

Thus, in the example of FIG. 5, the studs associated with the transmission channel 65A are distributed in three circumferential directions on either side of the channel 65A and in three radial directions at each end of this channel. For the sake of simplicity, in FIG. 5, only a circumferential direction 67A, 67B on each side of the channel 65A and a radial direction 68A, 68B at each end of this channel, are illustrated.

Similarly, the studs associated with the transmission channel 65B are distributed in three circumferential directions on either side of the channel 65B and in three radial directions at each end of this channel. For the sake of simplicity, in FIG. 5, only a circumferential direction 67C, 67D on each side of the channel 65B and a radial direction 68C, 68D at each end of this channel, are illustrated.

The spacing pitch of two neighboring studs in the corresponding circumferential or radial direction is, for example, substantially equal to 3.5 mm.

Moreover, in this same figure, the height of the studs associated with the transmission channel 65A, i.e. the channel for the Tx type signals, is substantially greater than the height of the studs associated with the transmission channel 65B, i.e., the channel for the Rx type signals. Thus, the height of the studs associated with the transmission channel 65A is, for example, substantially equal to 3 mm, while the height of the studs associated with the transmission channel 65B is, for example, substantially equal to 2 mm.

At the end of each transmission channel 65A, 65B, the transmission surface 61 defines an opening 71 to 74 respectively opening on a waveguide 75 to 78 formed between the fixing surface 62 and the stator hood 53.

Each waveguide 75 to 78 therefore extends in a plane perpendicular to the first axis X and appropriately bent to connect the corresponding transmission channel to the first guide means 36.

With reference to FIG. 4, the rotor 52 has the shape of a ring sector of constant opening substantially similar to that of the stator 51. As in the previous case, the opening of this sector is, for example, substantially equal to 160° and the center of this sector is arranged on the first axis X.

Like the stator 51, the rotor 52 is made of a single piece of conductive material and comprises a transmission surface 81 and a fixing surface 82 covered by the rotor cover 54.

In the minimum open position of the rotary joint 23, the transmission surface 81 of the rotor 52 is arranged substantially entirely opposite the transmission surface 61 of the stator 51.

In any other position of the rotary joint 23, a part of the transmission surface 81 of the rotor 52 is arranged to face a part of the transmission surface 61 of the stator 51. Moreover, in each of the maximum opening positions, the surface of the parts facing each other is minimal.

The first maximum open position is achieved by rotating the rotor 52 counter-clockwise about the first axis X. The second maximum open position is achieved by rotating the rotor 52 clockwise about the first axis X.

In any position of the rotor 52 with respect to the stator 51, the transmission surface 81 of the rotor 52 is spaced apart from the transmission surface 61 of the stator 51 along the first axis X by a distance that is substantially equal to, for example, 0.5 mm.

The transmission surfaces 61, 81 form between them a transmission plane of the electromagnetic signals. This plane is perpendicular to the first axis X and comprises, in any position of the rotor 52 relative to the stator 51, four transmission channels of electromagnetic signals as will be explained later.

The transmission surface 81 of the rotor 52 comprises two plane surfaces 83A, 83B and complementary delimiting means 84 of the electromagnetic signals.

Each planar surface 83A, 83B is associated with one of the transmission channels 65A, 65B of the stator 51 and is intended to completely cover this channel 65A, 65B with the main delimiting means 64 associated with this channel 65A, 65B, when the rotary joint 23 is in the minimum open position. Thus, each planar surface 83A, 83B has a circumferential shape.

The planar surfaces 83A, 83B are arranged in a stepped manner. Thus, in the example of FIG. 4, the plane surface 83B that is spaced apart from the first axis X protrudes with respect to the planar surface 83A by a value substantially equal to the differences in the heights of the studs associated with the transmission channel 65A and those associated with the transmission channel 65B.

The complementary delimiting means 84 of the electromagnetic signals are arranged on each of the planar surfaces 83A, 83B and protrude with respect to this surface 83A, 83B.

The complementary delimiting means 84 arranged on the planar surface 83A are received in the transmission channel 65A in a manner moves with the rotation of the rotor 52, so that in any position of the rotor 52 with respect to the stator 51, these means divide the corresponding transmission channel into two complementary circumferential transmission channels.

Likewise, the complementary delimiting means 84 arranged on the planar surface 83B are received in the transmission channel 65B in a movable manner with the rotation of the rotor 52, so that in any position of the rotor 52 with respect to the stator 51, these means divide the corresponding transmission channel into two complementary circumferential transmission channels.

The complementary delimiting means 84 are in the form of a plurality of studs arranged in a plurality of radial directions on either side of a central radial direction 86 of the transmission surface 81 and possibly in this same central radial direction 86.

The term "central radial direction" is understood to mean the radial direction passing through the middle of the sector of the rotor 52, i.e. the radial direction dividing the transmission surface 81 into two substantially equivalent parts.

Thus, in the embodiment of FIG. 4, the studs are arranged in the central radial direction 86 and in two other radial directions arranged on each side of the central radial direction.

The studs arranged on the planar surface 83A are similar to the studs associated with the transmission channel 65A, while the studs arranged on the planar surface 83B are similar to the studs associated with the transmission channel 65B.

Each planar surface 83A, 83B defines two openings 91 to 94 arranged on either side of the central radial direction 86. Each of these openings 91 to 94 is adjacent to the complementary delimiting means 84, so that in any position of the rotor 52 with respect to the stator 51, it opens on one side to one of the transmission channels 65A, 65B and on the other side to a waveguide 95 to 98 formed between the mounting surface 82 and the rotor cover 54.

Each waveguide 95 to 98 thus extends in a plane perpendicular to the first axis X and is appropriately bent by connecting the corresponding transmission channel to the second guide means 46.

Thus, the interaction of the rotor 52 with the stator 51, in any position of the rotor 52 with respect to the stator 51, forms four channels of transmission of the electromagnetic signals between the first part 21 of the antenna 10 and the second part 22.

Among these transmission channels, the channel formed between the openings 71 and 91 and the channel formed between the openings 74 and 94 are intended to transmit the electromagnetic signals for transmission via the radiating source 43. The channel formed between the openings 72 and 92 and the channel formed between the openings 73 and 93 are intended to transmit the electromagnetic signals received by the radiating source 43.

The operation of the antenna 10 and, in particular, its kinetics with respect to the X and Y axes will now be explained with reference to FIG. 6.

Figure 6:
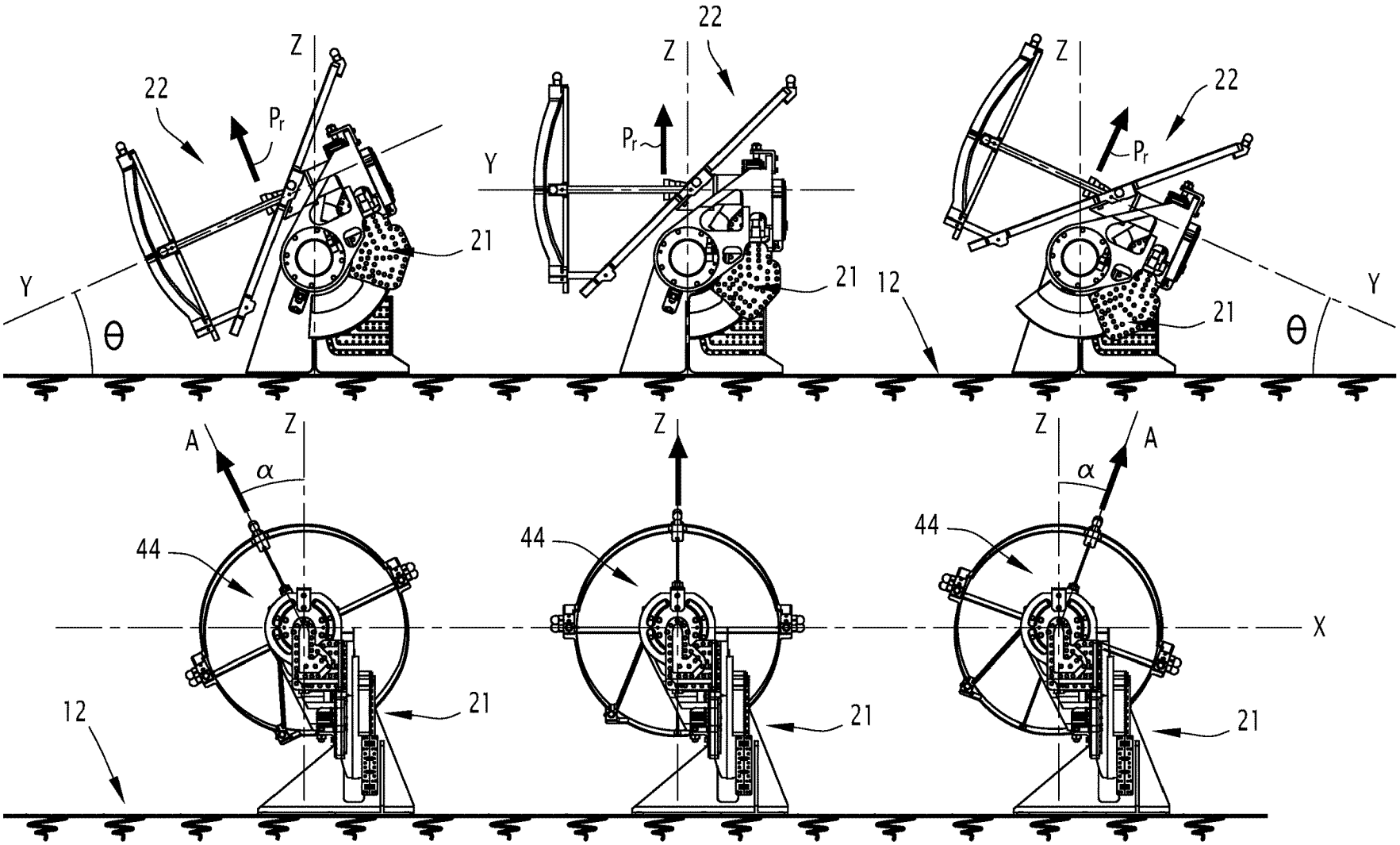
FIG. 6 shows a schematic view explaining the kinetics of the antenna of FIG. 1.

In fact, FIG. 6 illustrates in its upper part three different positions of the second part 22 with respect to the first part 21 of the antenna 10 during the rotation of the second part 22 with respect to the first axis which is then perpendicular to the plane of the upper part of FIG. 6.

In the middle position, the elevation angle Θ of the antenna 10 that is formed between the second axis Y and the base plane 12 is equal to 0°. The rotary joint 23 is therefore in its minimum open position.

When it is necessary to modify this elevation angle Θ, the first actuator is powered by the satellite to rotate the second part 22 of the antenna clockwise or counter-clockwise about the first axis X, depending on the sign of the corresponding supply signals.

Thus, in the left position, the second part 22 is rotated counter-clockwise about the first axis X to reach the elevation angle Θ that is substantially equal to −30°. In this position, the rotary joint 23 is therefore in its first maximum open position.

In the position on the right, the second part 22 is rotated about the first axis X in the clockwise direction to reach the elevation angle Θ that is substantially equal to 30°. In this position, the rotary joint 23 is therefore in its second maximum open position.

In its lower part, FIG. 6 illustrates three different positions of the reflection assembly 44 with respect, for example, to the first part 21 of the antenna 10 during the rotation of the reflection assembly 44 about the second axis Y, which is then perpendicular to the plane of the lower part of FIG. 6.

In the middle position, the angle of inclination a formed between the inclination axis A and the third axis Z is equal to 0°.

When it is necessary to modify this inclination angle α, the second actuator is powered by the satellite to rotate the reflection assembly 44 clockwise or counter-clockwise about the second axis Y, depending on the sign of the signals of the corresponding supply.

Thus, in the position on the left, the reflection assembly 44 is rotated counter-clockwise about the second axis Y to reach the inclination angle α that is substantially equal to −30°.

In the position to the right, the reflection assembly 44 is rotated about the second axis Y in the clockwise direction to reach the angle of inclination a that is substantially equal to 30°.

Thus, by varying the elevation angle Θ and the inclination angle α appropriately, it is possible to achieve a desired pointing position of the antenna 10 in a particularly accurate manner.

It will be appreciated that the present invention has a number of advantages.

Firstly, by using the rotary joint as described above, it is possible to receive and emit electromagnetic signals with a bandwidth that is substantially equal to 3 GHz width in transmission and 3 GHz width in reception, and a single horn for two orthogonal polarizations, while ensuring good performance of the antenna.

In addition, the antenna according to the invention is particularly simple in manufacturing and assembly because the electromagnetic connection between the first and second parts of this antenna is provided using a very small number of parts. In particular, this connection is provided entirely by the rotary joint which may comprise only of a stator and a rotor.

Finally, such a structure of the rotary joint is not at all sensitive to inaccuracies in the installation of its various components. In fact, the arrangement of the rotor slightly away from the stator is intended to prevent the "escape" of electromagnetic signals flowing in the transmission plane. Thus, this difference may be varied from one antenna to another without significant degradation of the performance of these antennas. In addition, since this rotary joint has no contact around the transmission channels, it does not limit the life of the antenna.

The invention claimed is:

1. A biaxial antenna comprising:

a first part intended to be fixed on a base defining a base;

a second part rotatably mounted about a first axis on said first part, comprising:

a radiating source emitting and receiving electromagnetic signals;

a reflecting assembly comprising:

a reflector arranged opposite said radiating source, said reflector defining a reflector top, a focus and a second axis passing through the reflector top and the focus, said reflecting assembly being rotatable about the second axis; and a mirror arranged around said radiating source and connected to said reflector in an inclined manner with respect thereto, wherein said first and second parts are so arranged that in any position of said second part and said reflecting assembly, the first axis is substantially perpendicular to the second axis; and a rotary joint arranged between said first and second parts able to transmit electromagnetic signals between said first and second parts via at least one transmission channel comprised in a transmission plane that is substantially perpendicular to the first axis, the transmission channel being delimited by a plurality of studs spaced apart from each other.

2. The antenna according to claim 1, wherein the first axis is parallel to the base plane.

3. The antenna according to claim 1, wherein the angle formed between the second axis and the base plane corresponds to an elevation angle of the antenna, wherein rotating said second part about the first axis changes the elevation angle of the antenna.

4. The antenna according to claim 1, wherein said mirror of said reflection assembly is a mirror having a shape that is adapted to the mission of the antenna.

5. The antenna according to claim 1, wherein said rotary joint is able to transmit electromagnetic signals between said first and second parts via at least two transmission channels that are distinct and separated from each other by the studs, wherein the two channels are comprised in the transmission plane.

6. The antenna according to claim 5, wherein one of the transmission channels is for transmitting electromagnetic signals received by said radiating source, while the other transmission channel is for transmitting electromagnetic signals for emission by said radiating source.

7. The antenna according to claim 1, wherein said rotary joint comprises:

a stator fixed to said first part; and a rotor fixed to said second part of the antenna and arranged at least in part to face said stator without contact therewith.

8. The antenna according to claim 7, wherein the transmission plane is between said stator and said rotor.

9. The antenna according to claim 7, wherein said stator and said rotor have similar shapes of a center ring sector arranged on the first axis.

10. The antenna according to claim 1, wherein the, or each, transmission channel extends in a circumferential direction defined relative to the first axis.

11. The antenna according to claim 1, further comprising a single exciter arranged in said second part and connected, firstly, to said radiating source and, secondly, to said rotary joint by waveguides or coaxial cables.

* * * * *